United States Patent [19]

Matthewson et al.

[11] Patent Number: 4,600,350

[45] **Date of Patent: * Jul. 15, 1986**

[54] METHOD AND APPARATUS FOR HANDLING CONTAINER CHASSIS

[75] Inventors: Randall W. Matthewson; Earl H. Benefiel; Ronald A. Brudi, all of Longview, Wash.

[73] Assignee: Brudi Equipment, Inc., Kelso, Wash.

[ * ] Notice: The portion of the term of this patent subsequent to Jan. 24, 2001 has been disclaimed.

[21] Appl. No.: 453,287

[22] Filed: Dec. 27, 1982

[51] Int. Cl.[4] ..... B66F 9/18

[52] U.S. Cl. ..... 414/267; 294/88; 294/106; 414/620; 414/678; 414/783; 414/786

[58] Field of Search ..... 414/31, 619, 620, 621, 414/678, 763, 783, 786, 917, 739, 741, 267; 294/88, 106; 206/335; 410/4, 5, 7, 24, 30

[56] References Cited

U.S. PATENT DOCUMENTS

| | | | |
|---|---|---|---|
| 1,807,360 | 5/1931 | Wehr | 294/106 |
| 2,604,220 | 7/1952 | Frischmann | 414/620 |
| 3,139,302 | 6/1964 | Orloff et al. | 294/88 |
| 3,154,339 | 10/1964 | Kaplan | 294/88 |
| 3,439,818 | 4/1969 | O'Neil | 294/106 X |
| 3,796,332 | 3/1974 | Kawamura | 294/106 X |
| 3,949,890 | 4/1976 | Keller | 414/620 X |
| 4,427,117 | 1/1984 | Matthewson et al. | 211/13 |
| 4,437,807 | 3/1984 | Perrott | 414/678 X |
| 4,439,094 | 3/1984 | Riley | 414/786 |

*Primary Examiner*—Leslie J. Paperner

*Attorney, Agent, or Firm*—Klarquist, Sparkman, Campbell, Leigh & Whinston

[57] ABSTRACT

A container chassis handling attachment for a lift truck having a lift carriage includes a frame for attachment to the lift carriage. It also includes a pair of upper and lower laterally-spaced forks independently mounted to the frame by separate four-bar linkages and movable by separate hydraulic cylinders. A clamp-positioning means cooperates with the forks to rotate the forks and any chassis gripped thereby through 180°. The attachment is used to store a chassis by clamping from one side opposing top and bottom surfaces of the chassis, lifting the chassis, rotating the chassis about 90° to a substantially upright position, and depositing the chassis in such position against a support. Alternatively, the chassis may be rotated 180° to an upside-down position and deposited onto an underlying right-side-up chassis, eventually to form a stack of alternating right-side-up, upside-down chassis.

16 Claims, 10 Drawing Figures

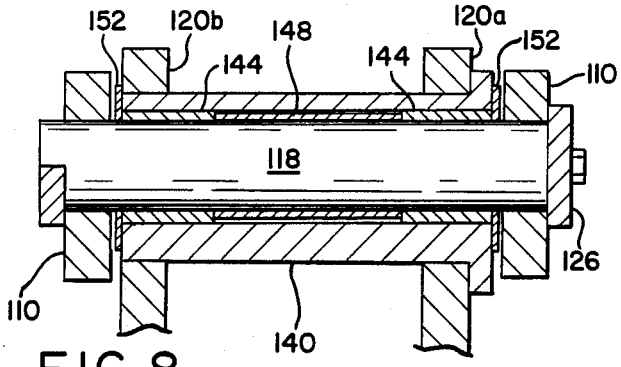
FIG. 8
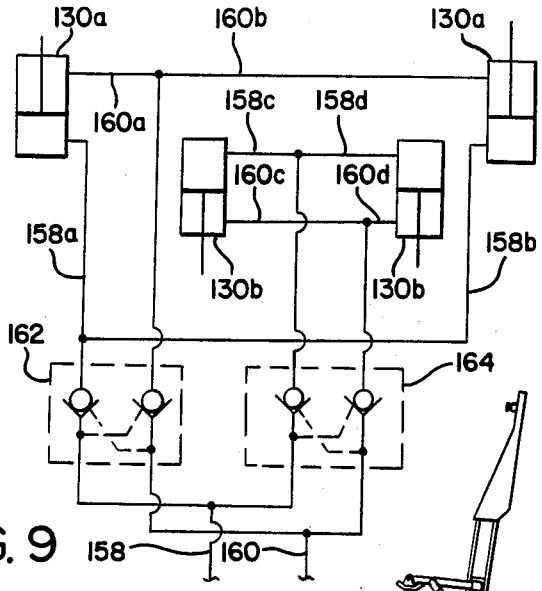
FIG. 9
FIG. 7
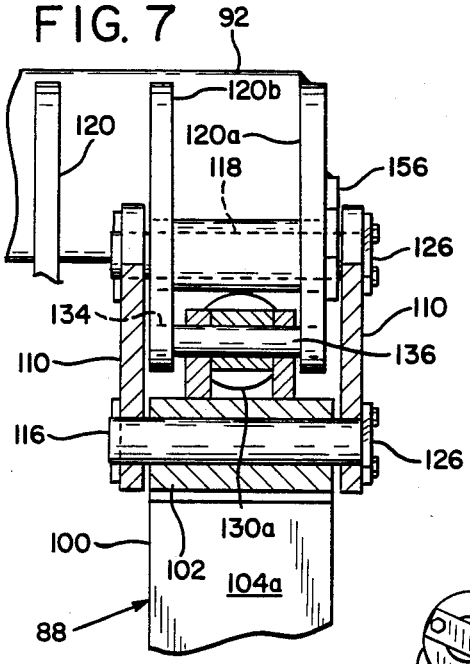
FIG. 10
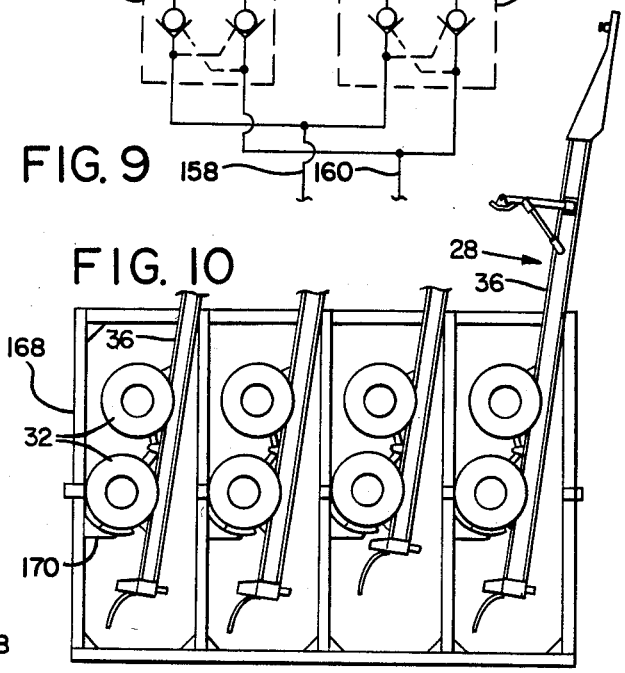
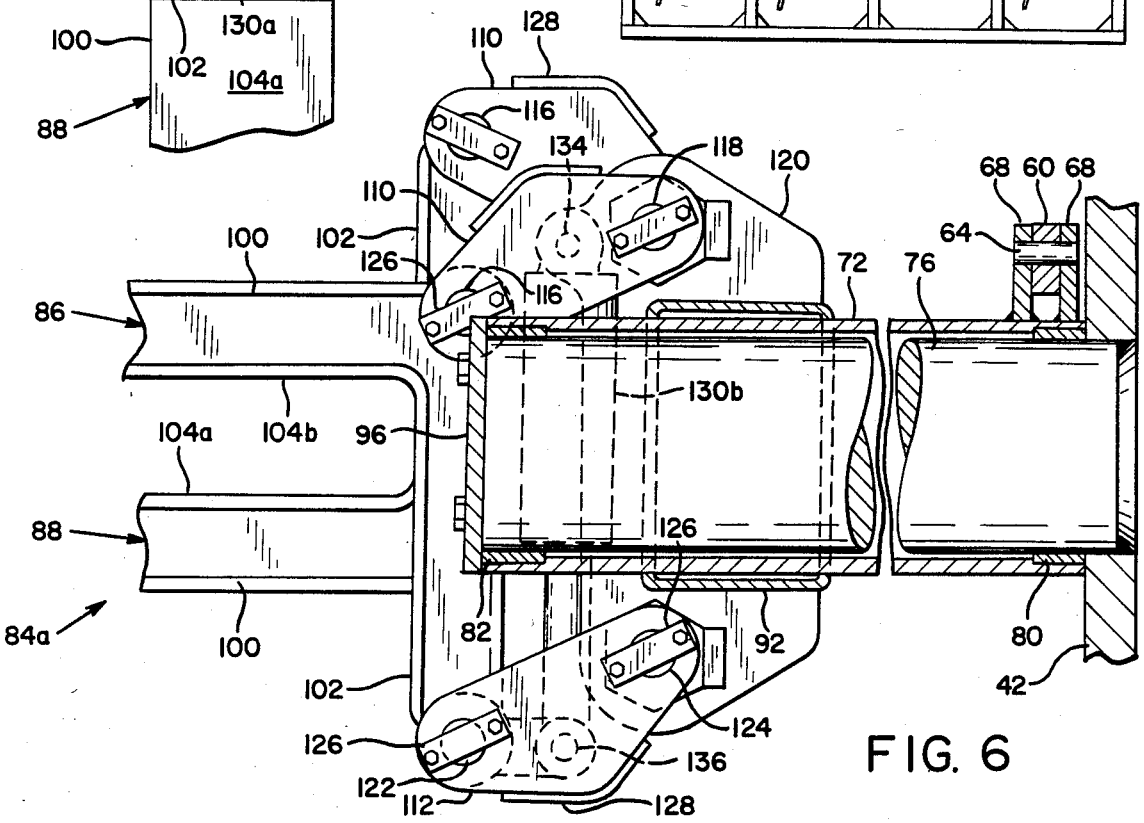
FIG. 6

METHOD AND APPARATUS FOR HANDLING CONTAINER CHASSIS

BACKGROUND OF THE INVENTION

The present invention relates generally to lift truck attachments and more particularly to attachments suitable for handling wheeled container chassis and the like.

Container trailer chassis are used to transport large, detachable shipping containers and their contents by road. The containers are detached from the chassis for shipment by rail or ship. Large numbers of empty container chassis are stored in storage areas at or near ship and rail terminals when not in use. However, the storage of such chassis is a problem because of their large size and bulky shape and because storage space is often scarce. Moving the chassis within the storage area or to and from loading points can also be a problem because of the lack of maneuvering space available for tractor vehicles and the typically disorganized manner in which the trailers are stored.

It has been suggested that chassis may be stored space efficiently in an upright position in storage racks, such as the storage rack shown in copending application Ser. No. 429,039, filed Sept. 30, 1982, now U.S. Pat. No. 4,493,421. The problem with this storage method, however, is that prior clamping apparatus and attachments for lift trucks are not suitable for handling chassis for upright storage.

Alternatively, the chassis may be stored in an alternating right-side-up, upside-down vertical stacking arrangement with the rear wheels of adjacent trailers positioned at opposite ends of the stack. Each upside-down chassis is flipped on its back onto a bed of tires using conventional lift truck forks, raised to the desired height and deposited onto a rightside-up chassis. Even with the tire bed, however, damage to the chassis can easily result. Moreover, the operation is relatively time consuming and requires space allocation for the tire bed.

An attachment suitable for efficiently handling chassis for storage in either of the above manners without damaging them must be capable of lifting a horizontal chassis off the ground, turning it 90° to an upright position or 180° to an inverted position, and depositing it gently against an underlying support. Such attachment must be able firmly to grip the large, bulky chassis with no risk of slippage while turning it. Ideally, such an attachment should be usable with conventional lift trucks. Such an attachment should also be capable of transporting a chassis in an upright position and with a slim horizontal profile to avoid the aforementioned maneuvering problem.

Examples of prior clamps for lift trucks capable of rotating gripped objects are shown in Weinert, et al. U.S. Pat. No. 4,177,000; Sinclair U.S. Pat. No. 3,896,957; and Overbeck U.S. Pat. No. 2,724,520. All three such clamps have curved clamping jaws specially designed for handling round objects, such as paper rolls and the like, and hence are not adapted for handling container chassis.

Moreover, the clamping jaws of the Sinclair and Weinert, et al. clamps are pivotally supported at common or closely adjacent axes at one end. The opposite clamping ends of the jaws therefore pivot through an arc to clamp the object. Consequently, such jaws are inherently incapable of generating an even clamping force across a relatively wide flat surface, such as the bed of a container chassis, and hence are not suitable for handling chassis.

The Overbeck clamp includes an upper, vertically movable clamping jaw and a stationary lower jaw. Because the upper jaw has a bar/slide type mounting, a ignificant portion of the potential clamping force is lost because of friction between the bar and slide. Consequently, a relatively large, energy inefficient fluid-operated cylinder would be required to handle container chassis. Therefore, the Overbeck clamp is also unsuitable for handling container chassis.

Accordingly, there is a need for a method and apparatus for handling container chassis that enables such chassis to be easily and safely stored and transported.

Therefore, a primary object of the invention is to provide a method and apparatus for handling and storing container trailer chassis.

Another primary object of the invention is to provide a lift truck attachment for handling container chassis that enables them to be stored in various space-efficient arrangements and retrieved therefrom, including vertically on-end and alternating right-side-up, upside-down arrangements.

Another object of the invention is to provide a method and apparatus for storing container chassis in an upright position.

Another object is to provide an apparatus and method for storing container chassis in an alternating right-side-up, upside-down stacking arrangement without damaging the chassis.

Yet another object is to provide an attachment, as aforesaid, with a clamping apparatus capable of applying a clamping force sufficient to prevent slippage of the chassis from its grip.

A further object is to provide an attachment, as aforesaid, in which the clamping apparatus is capable of applying an even clamping force across the full width of the chassis during handling.

A still further object is to provide an attachment, as aforesaid, in which the clamping apparatus includes means for positively preventing slippage of the chassis from its grip.

Another object is to provide an attachment, as aforesaid, capable of turning the chassis through at least 180° in a vertical plane and capable of gripping and releasing the chassis regardless of its orientation and without the need for a side-shaft mechanism.

Still another object is to provide a method and apparatus, as aforesaid, for handling a container chassis by applying a clamping force to the chassis near its center of gravity and from one side of the chassis.

SUMMARY OF THE INVENTION

The apparatus of the present invention comprises a container chassis handling attachment mountable to a load-lifting carriage of a lift truck. The attachment includes a clamping means for selectively gripping opposing top and bottom surfaces of a container chassis from one side of the chassis and positioning means cooperable with the clamping means capable of rotating the clamping means through 180° to turn the gripped chassis to either an upright or an inverted position for storage. The clamping means may include a pair of clamping members independently mounted to a common horizontal cross-beam of the clamping means by separate linkage means and movable by separate power operated means. The linkage means preferably includes at least one pair of parallel, vertically spaced links which pivotally interconnect the clamping member to the cross-beam for movement toward and away from the other clamping member.

According to the method of the invention, the chassis may be stored by approaching it from one side near its center of gravity and clamping its opposing top and bottom surfaces, lifting the chassis from a supporting surface to a height such that it can be freely rotated, rotating the chassis to a suitable position for storage and depositing the chassis against a support for storage in such position. According to one aspect of the method, the chassis are stored in generally vertical upright positions by leaning them against supporting surfaces. According to another aspect of the method, the chassis are stored in alternating right-side-up, upside-down positions one stacked atop the other horizontally.

BRIEF DESCRIPTION OF THE DRAWINGS

In the drawings:

FIG. 6 is a vertical sectional view taken along line 6—6 of FIG. 5.

FIG. 7 is a sectional view taken along line 7—7 of FIG. 5.

FIG. 8 is a sectional view taken along line 8—8 of FIG. 4.

FIG. 9 is a hydraulic circuit diagram of a hydraulic control circuit for the attachment.

FIG. 10 is a side elevational view of a storage rack for storing multiple chassis in an upright position in accordance with a method of the invention.

DETAILED DESCRIPTION OF A PREFERRED EMBODIMENT

Figure 1:
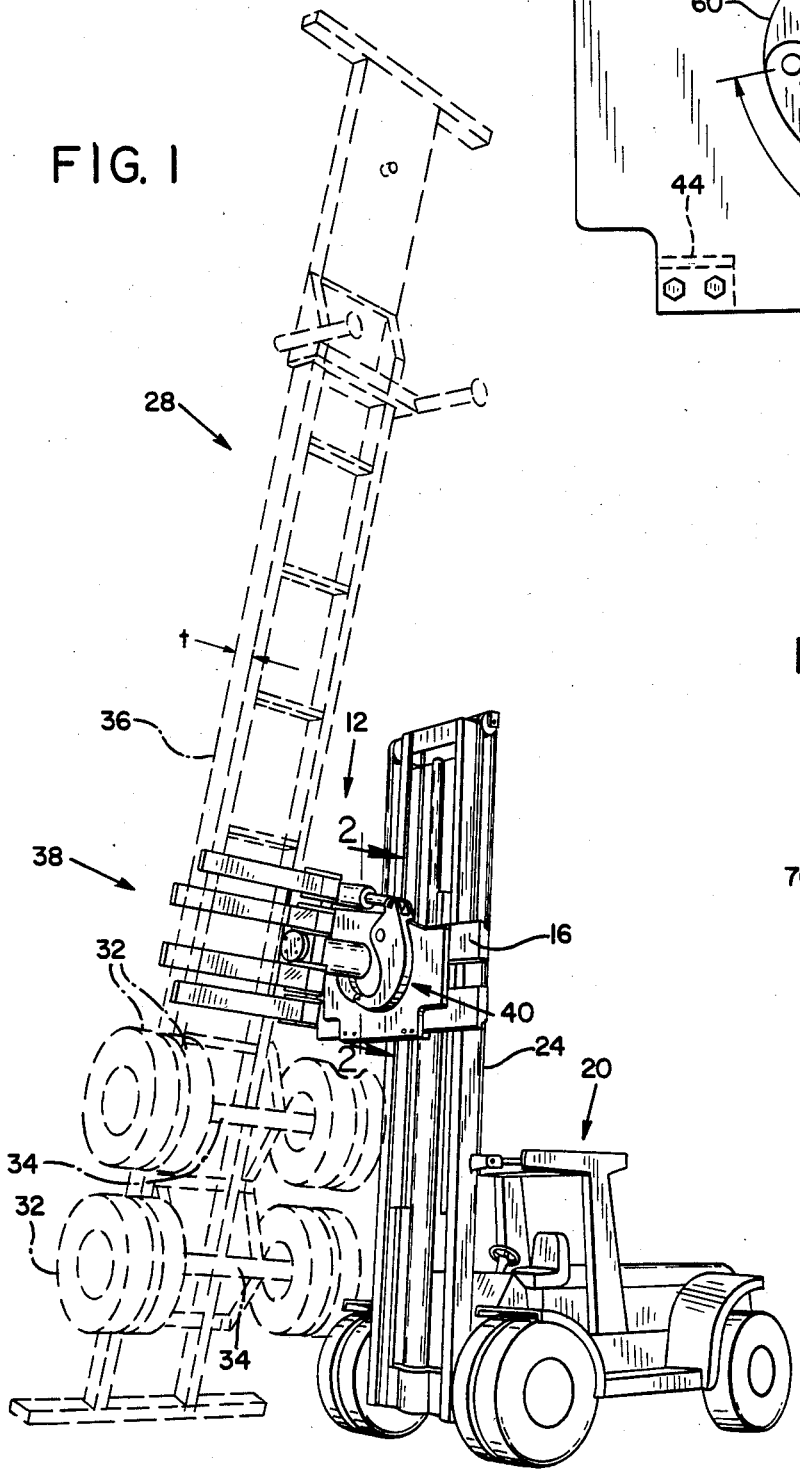
FIG. 1 is a perspective view showing a lift truck attachment in accordance with the present invention mounted to a load-lifting carriage of a lift truck and lifting a typical container chassis (shown in dashed lines).

Referring to FIG. 1, a lift truck attachment 12 in accordance with the present invention is mounted to a lift carriage 16 of a fork lift 20. Lift carriage 16 is mounted for movement up and down along a mast 24 of the lift truck in a conventional, known manner.

The attachment is particularly suited for handling a container trailer chassis 28 having dual rear wheels 32 on tandem axles 34 suspended from an elongate chassis frame 36. Frame 36 has opposed top and bottom surfaces which define a thickness dimension "t" for the chassis therebetween.

The attachment includes clamping means 38 operable to selectively grip and release the opposed top and bottom surfaces of the chassis and clamp positioning means in the form of a rotator mechanism 40 cooperable with the clamping means for rotating the gripped chassis to a desired position for storage of transportation.

Figure 2:
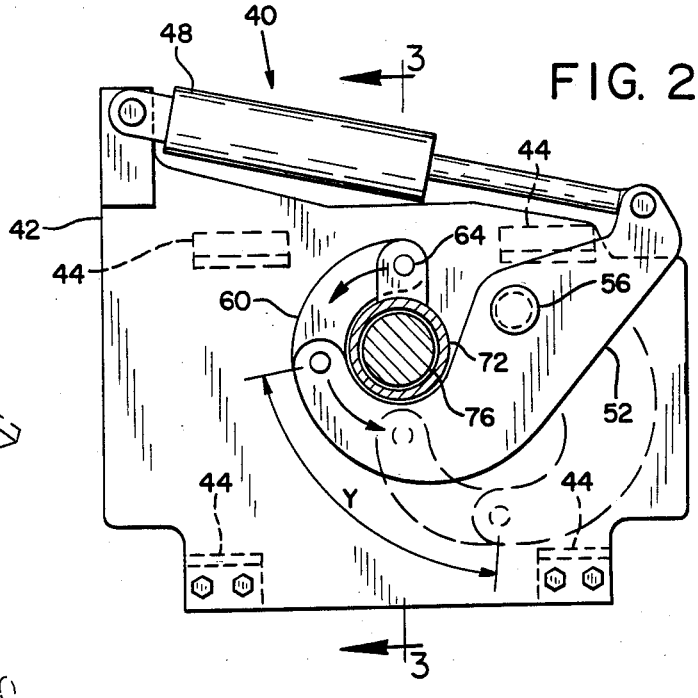
FIG. 2 is a frontal view of the rotator portion of the attachment of FIG. 1 as viewed from the line 2—2 of FIG. 1.
Figure 3:
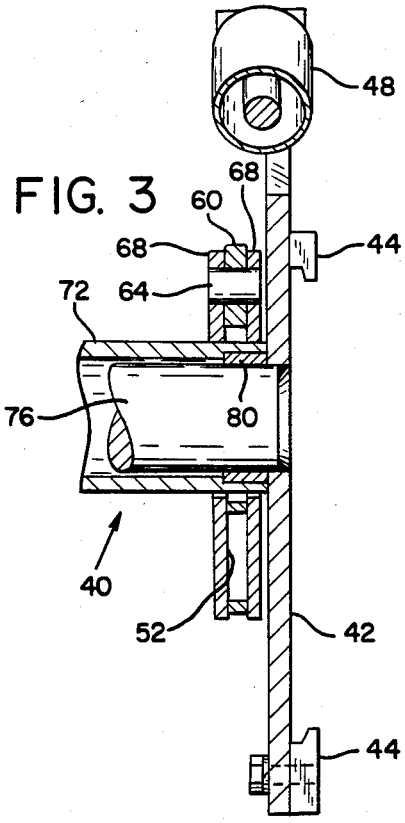
FIG. 3 is a vertical sectional view taken along line 3—3 of FIG. 2.

A preferred clamp positioning means for the attachment, shown in FIGS. 2 and 3, includes a main frame 42 suspended by hooks 44 to the carriage of a lift truck for vertical movement. A fluid-actuated cylinder 48, pivoted at one end to frame 42 and at its other end to a bell crank 52, pivots the bell crank about a shaft 56 (FIG. 2). A drag link 60 is pivoted at one end to the bell crank. The opposite end of the drag link carries a pin 64 having ends journaled within a pair of laterally-spaced ears 68 (FIG. 3). Ears 68 are affixed to a hollow shaft 72 which supports the clamping means. The axis of rotation of pin 64 and hence shaft 72 is determined by a spindle 76 welded to frame 42. Spindle 76 mounts shaft 72 and its supported clamping means 38 through bearings 80 and 82 (FIG. 6).

As shown in FIG. 2, retraction of cylinder 48 rotates bell crank 52 about shaft 56, causing the bell crank to move through an arc "y" to the dashed line position shown. This in turn enables pin 64 (and hence shaft 72) to rotate 180° about spindle 76, as illustrated by the arrows. Extension of the cylinder, of course, causes shaft 72 to rotate in the opposite direction.

An alternative clamp positioning means capable of 180° rotation is shown in Brudi, et al. U.S. Pat. No. 3,876,100.

Figure 4:
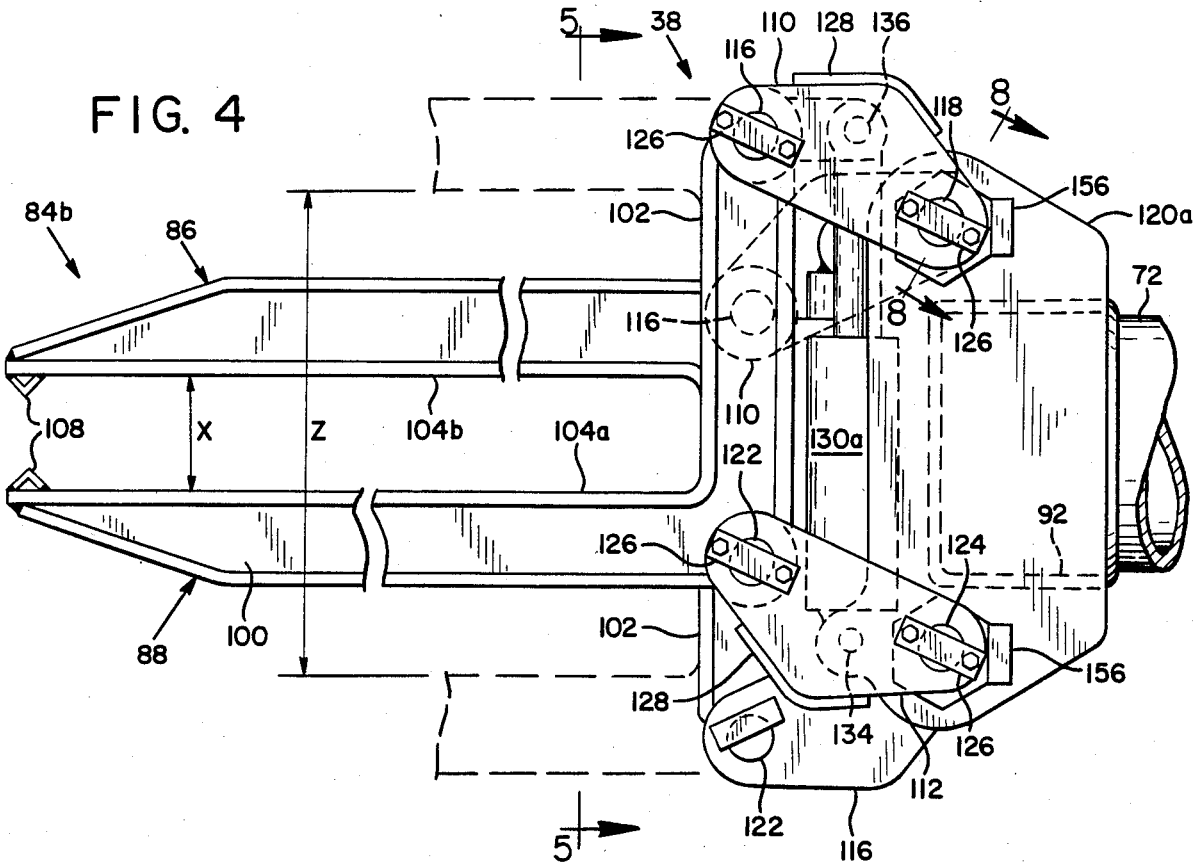
FIG. 4 is a side elevational view of the clamping apparatus portion of th attachment of FIG. 1.
Figure 5:
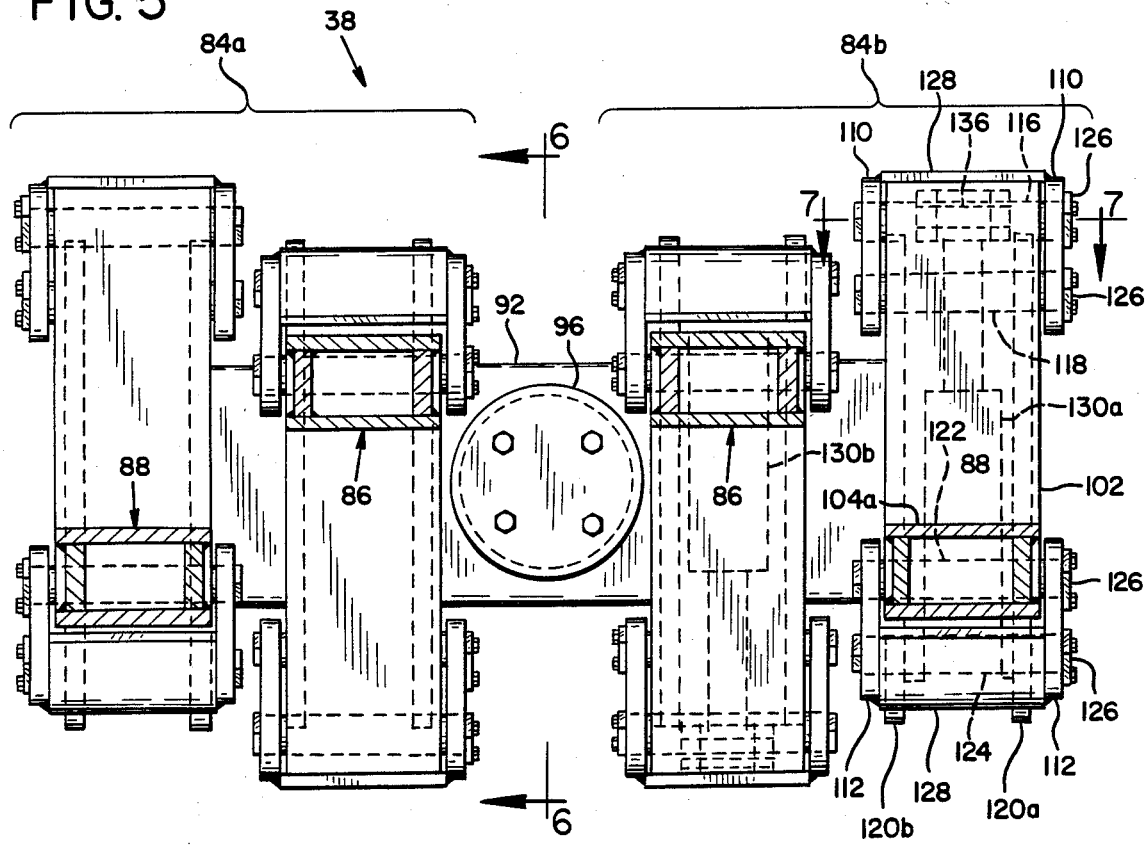
FIG. 5 is a sectional view taken along line 5—5 of FIG. 4.

With reference to FIGS. 4–7 and especially FIG. 5, the clamping means includes two sets of clamping memebers 84*a* and 84*b*, each set having an upper clamping member or fork 86 and a lower clamping member or fork 88, each mounted for movement toward and away from the other. Each fork is independently mounted to a common stationary cross-beam 92 which in turn is mounted, such as by welding, to shaft 72. Shaft 72 forms part of th rotator mechanism to enable rotation of the clamping means. Cross-beam 92, and hence the clamping means, is prevented from sliding forwardly off spindle 76 by a cap 96 (FIGS. 5 and 6) bolted to the spindle and by the connection of ears 68 to link 60.

With particular reference to FIG. 4, lower fork 88 of clamping member 84*b* is L-shaped and has a long clamping portion 100 and a short upright leg portion 102 for mounting the fork to cross-beam 92. The clamping portion has a clamping surface 104*a* oppositely directed to a clamping surface 104*b* of fork 86 for gripping a chassis therebetween. Anti-slip means include aluminum oxide particles embedded in surfaces 104*a*, 104*b* to provide nonslip surfaces for gripping the chassis. The clamping portion is long enough to span the full width of the chassis, typically about 40 inches, and includes a stop means, such as stop 108, disposed near its tip to prevent forward slippage of the chassis away from the lift carriage.

Lower fork 88 of clamping member 84*a* is identical to the fork just described. Upper forks 86 of clamping members 84*a* and 84*b* are also identical, except that they are invented relative to the lower forks and hence have downwardly directed clamping surfaces.

Upper and lower forks 86, 88 are each independently mounted to cross-beam 92 by a linkage means for movement toward and away from one another. Except for minor differences described below, the linkage means of each fork is the same.

Referring to FIGS. 4, 5, and 7, for example, the linkage means of lower fork 88 of clamping member 84*b* includes a pair of upper, parallel laterally spaced links 110 and pair of lower, parallel laterally spaced links 112 which together form a four-bar linkage. The upper links are pivotally mounted at one end to a common pin 116 centrally supported by leg 102 and at the other end to a common pin 118 supported by a pair of adjacent, laterally-spaced support plates 120*a*, 120*b*. Similarly, the lower links are supported by common pins 122 and 124. Bars 126 bolted to the links prevent lateral slippage of the pins. A pair of stabilizing plates 128 welded to the upper and lower links provides lateral stability for the linkage means.

Both support plates 120*a*, 120*b* are affixed to cross-beam 92, such as by welding. Support plate 120*a* is trapezoidal in shape and welded to an outer end surface of cross-beam 92, while support plate 120*b* is C-shaped and welded to a more central portion of the cross beam fitted within its crotch.

A fluid-operated extensible means, in this case a cylinder 130*a*, operates vertically to move lower fork 88. Cylinder 130*a* is pivotally connected at one end to a pin 134 supported by two laterally-spaced ears of adjacent support plates 120*a*, 120*b*. The other end is pivotally connected to a pin 136 supported by a pair of laterally-spaced ears protruding rearwardly from leg 102. Extension of the piston rod of cylinder 130*a* moves the fork upwardly through an arc as upper and lower links 110 and 112 pivot about pins 118 and 124, respectively. Retraction of the piston rod moves the fork downwardly through an arc. The arc is so slight as to cause only nominal forward and rearward movement of the fork.

Lower fork 88 of clamping member 84*a* is supported and operated by a cylinder (not shown) in the manner just described. Similarly, upper forks 86 of clamping members 84*a* and 84*b* are supported and operated in the same manner as the lower forks 88, except for minor differences. The upper forks themselves and cylinders 130*b* associated therewith are, of course, inverted relative to the lower forks. Thus, extension of the piston rod of cylinder 130*b* of clamping member 84*b* lowers the fork through downward pivoting of the upper links and lower links. Additionally, the pair of support plates 120 associated with each upper fork are both C-shaped to receive cross-beam 92.

The cylinders associated with each fork together comprise a power operated means to move the upper and lower forks toward and away from one another to clamp and release a chassis. As shown in FIG. 4, the cylinders operate to move the upper and lower forks through a distance varying from a minimum spacing of "x" to a maximum spacing "z." Because chassis have varying thicknesses "t" (FIG. 1), the spacing "x" should be less than the "thinnest" chassis to be handled by the attachment. Similarly, the spacing "z" should be sufficiently greater than the "thickest" chasis to be handled by the attachment to provide plenty of clearance for stops 108 when the chassis is released by the forks and the lift truck backs away. A range of from 5 to 22 inches should accommodate most, if not all, standard size chassis which range from 8 to 20 inches in thickness.

Referring to FIG. 8, pin 118 mounting upper links 110 of lower fork 88 (clamping member 84*b*) to support plates 120*a*, 120*b* is journaled within an adjustable eccentric means capable of translating the pivot axis of the links, as determined by such pin. Such translation varies the relationship of clamping surface 104*a* relative to a horizontal plane.

Such eccentric adjustment means includes an eccentric 140 within which pin 118 is journaled. Eccentric 140 has a hexagonal head and supports the pin through a pair of bushings 144 separated by a spacer 148. Bearings 152 separate the ends of eccentric 140 from the opposed links. The eccentric is adjusted by removing a stop 156 (FIG. 4), rotating the hexagonal head of the eccentric with a wrench or other suitable tool and reconnecting the stop.

Pin 124 mounts lower links 112 in the same manner. The upper and lower links of the other forks are identically supported. Therefore, for example, the clamping surfaces of the upper and lower forks of one or both clamping members may be adjusted by translation of the pivot axes of the links to define converging planes in a direction moving outwardly toward the tips, an arrangement which causes the greatest clamping force to be applied at the tips of the forks. Conversely, the forks may be adjusted to define diverging planes, thereby causing the greatest clamping force to be applied near legs 102.

As shown in FIG. 9, all four fork cylinders are connected in parallel with one another in a common hydraulic circuit having lines 158, 160 which interchangeably act as pressure and return lines, depending upon whether cylinders 130 are being extended or retracted. Double pilot-operated check valves 162, 164, one for the pair of lower fork cylinders 130*a* and the other for the pair of upper fork cylinders 130*b*, maintain clamping pressure in lines 158*a*, 158*b*, 158*c*, 158*d* in the event of rupture of line 158 or pump failure, thereby to prevent a loss of clamping pressure. Similarly, pressure is maintained in lines 160*a*, 160*b*, 160*c*, 160*d* when line 160 is the pressure line. Each check valve associated with lines 158 and 160 is referenced to the other line. Thus, when one line acts as a pressure line, pressure from such line opens the check valve of the other line, thereby enabling fluid to return from the cylinder through such other line to a fluid reservoir.

With the described parallel arrangement, the fluid pressure in the pressure line of each cylinder is necessarily equal. Thus, no one fork can apply an unbalanced force to the chassis. For example, if in clamping a chassis one of the lower forks 88 engages the chassis befroe the other forks, such fork is inherently prevented from exerting an unopposed upward force on the chassis because the pressure in the pressure line to cylinder 130*a* cannot exceed the pressure in the other parallel lines.

Operation and Method of Handling Chassis

In one method of handling container chassis with the above attachment, the lift truck operator approaches the side of a horizontal chassis with the lift carriage generally aligned with the height of such chassis. The upper and lower forks are operated to grip the opposing top and bottom surfaces of the chassis near its longitudinal center gravity just forwardly of its rear wheels. The lift carriage and gripped chassis are then raised to a height such that the chassis can be freely rotated. The chassis is rotated, with its short end moving downwardly, about 90° to a substantially vertical position in which it can be easily transported through narrow aisles or supported for storage by a storage means or support in such position. In this way, even a relatively small lift truck with sufficient load capacity is capable of rotating the long chassis using minimal power. In an upright position, the chassis can be transported with the narrowest possible transverse profile, a result which is not possible when the chassis is approached from one end, gripped and pivoted to an upright position.

One such storage means, a support structure or apparatus 168, is shown in FIG. 10 and described in application Ser. No. 429,039, filed Sept. 30, 1982, now U.S. Pat. No, 4,493,421. Structure 168 has separate side-opening stalls for storing multiple chassis in a substantially vertical position. Such structure includes support means, such as wheel supports 170, in each stall for supporting the rearmost wheels of the chassis. The gripped chassis is maneuvered or inserted sideways into the stall and lowered against wheel support 170. The grip of the clamping means is then released and the lift truck backed away from the stall.

A chassis stored in this way may be easily retrieved for use simply by reversing the above procedure.

In an alternative method of handling chassis for storage, the chassis is gripped and lifted in the foregoing manner and rotated 180° to an inverted position. It is then deposited onto an underlying right-side-up chassis. In this way, multiple chassis may be stacked one on top of the other, preferably in an alternating right-side-up, upside-down arrangement with adjacent stacked chassis having horizontally-opposed rear wheels. In such arrangement, the "right-side-up" chassis obviously would not have to be rotated. It has been found that five or six chassis may be stacked in this way.

The above methods of handling chassis for storage or transportation are made feasible by the attachment herein described. The attachment enables a long, bulky and heavy chassis to be firmly gripped and rotated with little or no risk of the chassis slipping from the grip of the forks, a consequence which could seriously damage the chassis or harm nearby persons. More specifically, the unique manner of supporting the forks using a linkage means allows the power-operated means to generate a maximum clamping force that is not reduced by the friction loss attendant with conventional bar-slide type clamp supports. Such increased clamping force along with the antislip means and stop means positively prevents the chassis from slipping from the forks while turned. Finally, the chassis are handled easily and efficiently for storage in a manner which does not require the chassis to be flipped onto the ground.

It will be appreciated from the foregoing that various modifications can be made to the above-described preferred embodiment. For example, one set of forks, either the upper or lower, can be made stationary and a second set operated by a single centered hydraulic cylinder using the same basic linkage. Also, for example, the cylinders can be connected at their opposite ends to the links themselves instead of to the ears of the support plates and forks.

Having illustrated and described the principles of our invention by what is presently a preferred embodiment and several suggested alternatives, it should be apparent to those persons skilled in the art that such embodiments may be modified in arrangement and detail without departing from such principles. We claim as our invention all such modifications as come within the true spirit and scope of the invention as defined by the following claims.

We claim:

1. In combination:

a container chassis handling apparatus for attachment to the lift carriage of a lift truck, and a storage apparatus for storing unloaded container chasis having a thin, elongate and wide frame and a wheel assembly mounted to a rear portion of same frame;

said lift truck having a longitudinal axis;

said handling apparatus comprising clamping means for selectively gripping and releasing opposing top and bottom surfaces of said chassis frame and clamp positioning means cooperable with said clamping means for rotating said clamping means and container chassis gripped thereby about a horizontal axis extending parallel to the longitudinal axis of said lift truck and passing transversely through said frame forwardly of said wheel assembly, thereby to facilitate moving said chassis between generally horizontal and vertical positions;

said storage apparatus including multiple, side-opening storage stalls and support means in each stall for supporting said chassis in a generally vertical position for storage, whereby said chassis can be inserted by said clamping means sideways into said stalls and released from said clamping means for support by said support means.

2. A method of storing an unloaded container chassis having a thin, elongate and wide frame and a wheel assembly mounted to a rear portion of said frame, the method comprising:

approaching said container chassis from one side;

clamping from one side opposing top and bottom surfaces of said container chassis forwardly of said wheel assembly;

lifting said chassis from a supporting surface to a height such that said chassis can be freely rotated;

rotating said chassis about a horizontal axis passing transversely through said chassis frame forwardly of the wheel assembly from a generally horizontal position to a generally vertical position; and inserting the generally vertical chassis sideways into a side-opening storage stall for storage in such position.

3. the method of claim 2 wherein the chassis is clamped across its full width.

4. The method of claim 2 wherein said chassis is rotated such that said wheel assembly moves initially downwardly from a horizontal position.

5. An attachment for a lift truck having a lift carriage, said attachment being adapted for handling unloaded container chassis and the like, comprising:

a frame for attachment to said lift carriage and movable vertically therewith;

rotator means carried by said frame for rotating a load relative to said frame; and clamping means carried by said rotator means for selectively gripping and releasing, from the side, opposing top and bottom surfaces of a container chassis;

said clamping means including a stationary support for attachment to said rotator means, a pair of clamping members having oppositely directed clamping surfaces, linkage means pivotally interconnecting at least one clamping member to said support for movement toward and away from the other clamping member and relative to said support, and power operated means for effecting such movement;

said linkage means including adjustable eccentric means for connecting said linkage means to said support, said eccentric means being selectively adjustable to vary the position of the pivot axis of said linkage means and thereby to vary the angular disposition of said clamping surfaces relative to a horizontal plane.

6. An attachment according to claim 5 including linkage means interconnecting the other clamping member to said support for movement toward and away from said interconnected clamping member and relative to said support, whereby said clamping members are mutually movable by said power operated means toward and away from one another to grip and release said chassis therebetween.

7. An attachment according to claim 5 wherein said clamping members have a continuous length sufficient to span the full width of said chassis from one side and said clamping surfaces are planar to engage the top and bottom surfaces of said chassis.

8. An attachment according to claim 5 wherein said clamping surfaces include anti-slip means for inhibiting slipping movement of said chassis relative to said clamping surfaces when said chassis is gripped by said clamping surfaces.

9. An attachment according to claim 5 wherein said power operated means includes fluid operated extensible cylinder means associated with each clamping member.

10. An attachment according to claim 9 wherein said cylinder means is connected at one end to said support and at the other end to said clamping member.

11. An attachment according to claim 5 wherein said clamping members are generally L-shaped and have one leg that is parallel to said support, said linkage means including at least one pair of parallel, vertically-spaced links associated with each said clamping member, said links being pivotally connected at one end of said support and at the other end to said clamping member.

12. An attachment according to claim 5 wherein each said clamping member includes a pair of laterally spaced forks independently mounted to said support by separate linkage means and movable by separate power operated means.

13. An attachment according to claim 12 wherein the power operated means for each fork includes a hydraulic cylinder connected in parallel in a common hydraulic circuit with the other cylinders.

14. An attachment according to claim 12 wherein the lower said forks are laterally offset from the upper said forks.

15. An attachment according to claim 5 wherein said rotator means is operable to rotate said clamping means and a container chassis gripped thereby 180° about said horizontal axis.

16. An attachment according to claim 5 wherein each said clamping member includes a pair of laterally spaced forks independently mounted to said support by separate linkage means and movable by separate power operated means, each said power operated means including a hydraulic cylinder connected in parallel on a common hydraulic circuit with the other cylinders, each said linkage means including at least one pair of parallel, vertically-spaced links, each said link being pivotally connected at one end to said support and at the other end to said fork, said forks having a length sufficient to span the full width of said chassis from one side and planar clamping surfaces to engage the top and bottom surfaces of said chassis.

* * * * *

UNITED STATES PATENT AND TRADEMARK OFFICE
CERTIFICATE OF CORRECTION

PATENT NO. : 4,600,350

DATED : July 15, 1986

INVENTOR(S) : Randall W. Matthewson, Earl H. Benefiel, Ronald A. Brudi

It is certified that error appears in the above-identified patent and that said Letters Patent is hereby corrected as shown below:

In the Specification:

Column 2, line 6, "ignificant" should be --significant--;
Column 4, line 25, "memebers" should be --members--;
Column 4, line 31, "th" should be --the--;
Column 5, line 37, "both" should be --both--;
Column 6, line 37, "befroe" should be --before--; and
Column 6, line 68, "No," should be --No.--.

In the Claims:

Column 8, line 33, "the" should be --The--.

Signed and Sealed this

Twenty-fifth Day of November, 1986

*Attest:*

DONALD J. QUIGG

*Attesting Officer*

*Commissioner of Patents and Trademarks*